United States Patent [19]

Diamond

[11] 3,958,825

[45] May 25, 1976

[54] BEAM CLAMP

[76] Inventor: Irving Diamond, 161 Wilder St., Hillside, N.J. 07205

[22] Filed: Feb. 18, 1975

[21] Appl. No.: 550,734

[52] U.S. Cl. ..... 294/78 R; 59/93; 294/92

[51] Int. Cl.[2] ..... B66C 1/64

[58] Field of Search ..... 294/78 R, 82 R, 83 R, 294/85, 92; 24/230.5 T; 59/84, 85, 90, 93

[56] References Cited

UNITED STATES PATENTS

| | | | |
|---|---|---|---|
| 800,561 | 9/1905 | Feild | 59/85 |
| 1,721,801 | 7/1929 | Alexander | 59/85 |
| 2,354,107 | 7/1944 | Diamond | 294/78 R |
| 2,538,356 | 1/1951 | Donda | 59/85 |
| 2,693,386 | 11/1954 | Renfroe | 294/92 |
| 3,330,106 | 7/1967 | Spilhaug | 59/85 |

FOREIGN PATENTS OR APPLICATIONS

| | | | |
|---|---|---|---|
| 81,139 | 6/1954 | Norway | 294/82 R |

*Primary Examiner*—Johnny D. Cherry
*Attorney, Agent, or Firm*—Shapiro and Shapiro

[57] ABSTRACT

In a beam clamp having a pair of arms suspended from a lifting ring, the ring is formed of two parts — a rod portion, and a plate portion with notched ends receiving corresponding ends of the rod portion and welded thereto. The rod portion, which has circular cross-section, is bent to form a circular arc and is inserted through holes in the arms. The plate portion, which has rectangular cross-section, follows a different curvature to render the ring self-centering when suspended from a chain, the ends of the plate portion being too large to enter the holes in the arms. The arms have replaceable jaws which are fixed to the arms by screws.

6 Claims, 4 Drawing Figures

BEAM CLAMP

BACKGROUND OF THE INVENTION

This invention is concerned with beam clamps and more particularly with an improved beam clamp having advantages to the manufacturer and to the user.

In my prior U.S. Pat. No. 2,354,107, granted July 18, 1944, a beam clamp is disclosed comprising a pair of arms suspended from a ring, the arms having jaws for engaging the flanges of a beam. Although the beam clamp of my prior patent serves its intended purposes admirably, it has certain characteristics that increase the cost both to the manufacturer and to the user. First, the ring for suspending the arms is formed from a single rod of circular cross-section which must be bent to its final circular form after it has been inserted through holes in the arms. Then the ends of the ring must be abutted and welded together. The bending operation with the arms in place is cumbersome, and the welding operation is difficult and expensive. Excessive material at the weld must be chipped away. Second, the jaws, which are integral with the arms or welded in place, are difficult to replace when worn. Jaw replacement requires an expensive flame cutting operation, and it is frequently less expensive to replace the whole beam clamp.

SUMMARY OF THE INVENTION

It is accordingly a principal object of the present invention to provides an improved beam clamp of the general type disclosed in my prior patent.

A further object of the invention is to provide an improved beam clamp in which the ring is easier and less expensive to manufacture and in which the jaws are easily and inexpensively replaced.

Briefly stated, in accordance with a preferred form of the invention, the ring of a beam clamp is formed of two parts — a preformed rod portion of circular cross-section, and a pre-formed plate portion of rectangular cross-section. The ends of the plate portion are provided with notches into which the ends of the rod portion are inserted after the rod portion has been assembled with beam clamp arms, and then the portions of the ring are welded together. The configuration of the plate portion is such that the ring is self-centering when suspended from a chain, and the ends of the plate portion are incapable of entering the holes in the arms by which the arms are suspended from the rod portion. The arms have jaws that are separable from the arms proper and are held thereto by screws which extend through portions of the arms and are then terminally threaded into the jaws.

BRIEF DESCRIPTION OF THE DRAWINGS

The invention will be further described in conjunction with the accompanying drawings, which illustrate a preferred and exemplary embodiment of the invention, and wherein.

DETAILED DESCRIPTION OF THE INVENTION

Figure 1:
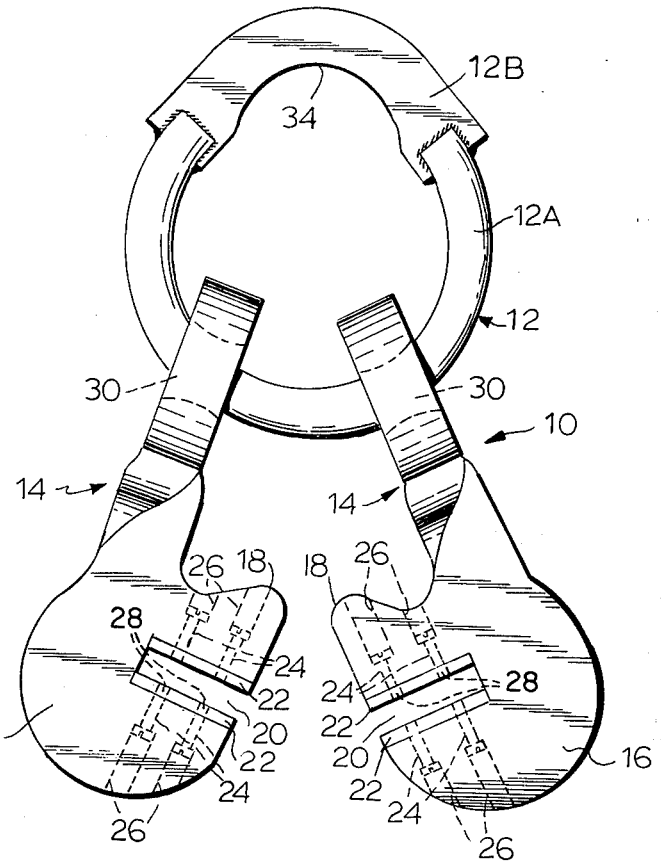
FIG. 1 is an elevation view of a beam clamp illustrating the arms suspended from the ring in accordance with the invention.

The improved beam clamp 10 comprises a ring 12 and two arms 14 each having jaw sections 16. The jaw sections 16 are provided with hook members 18 and slots 20. Juxtaposed with opposite sides of the slots are removable jaws 22. The jaws are constituted by plates secured to the arms by screws 24. The screws extend through bores 26 in the jaw sections at opposite sides of slots 20 and are terminally threaded into corresponding threaded holes 28 in the jaws. As shown, the screws are countersunk into the jaw sections of the arms and have end surfaces which are flush with the gripping surfaces of the jaws, which may be serrated or roughened for better gripping. The jaws are easily removed when worn and may be formed of a strong wear-resistant steel tailored to the intended gripping action, independent of the properties of the arms proper, and without concern for the deleterious effects of heat treating or working of the arms proper or welding the jaws to the arms.

Figure 2:
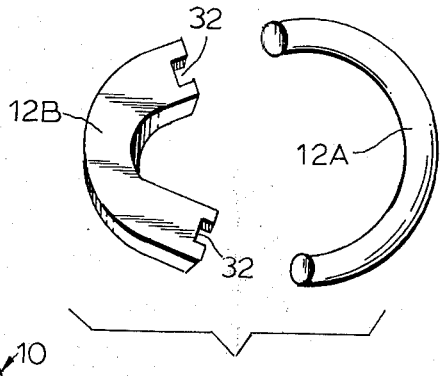
FIG. 2 is an exploded perspective view illustrating the portions of the ring prior to assembly.

As shown in FIG. 2, the ring 12 is formed from two parts — a rod portion 12A and a plate portion 12B. Unlike the ring of my prior patent, which must be bent into its circular form after assembly with the arms, the rod portion 12A, which is of circular cross-section, is pre-bent to a circular arc prior to assembly with the arms 14. Then the rod portion 12A is inserted through the hole 30 of the arms and is assembled with the pre-formed plate portion 12B. The ends of the plate portion 12B are formed with rectangular notches 32, respectively, which receive and fit corresponding ends of the rod portion 12A. Then the portions of the ring are welded together, as shown in FIG. 1, by a simple and inexpensive welding operation.

Figure 3:
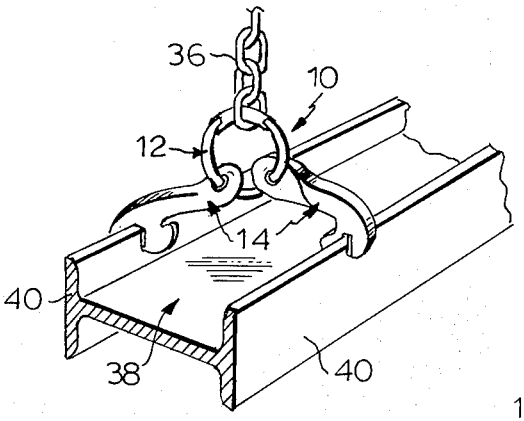
FIGS. 3 and 4 are fragmentary perspective views illustrating the use of the improved beam clamp of the invention.
Figure 4:
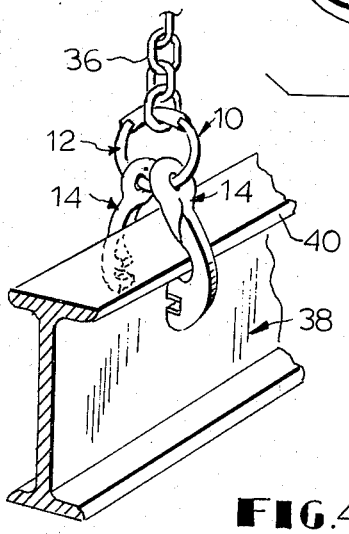

The plate portion 12B, which is of rectangular cross-section, has a pre-formed curvature different from the curvature of the rod portion 12A. As shown, the inner side 34 of the central section of the plate portion 12B comprises in arc with a smaller radius of curvature than the radius of curvature of the rod portion 12A, so that the ring tends to remain centered symmetrically with respect to the lowermost link of a suspending chain 36, as shown in FIGS. 3 and 4. The ends of the plate portion 12B are too large to enter the holes 30 of the arms, so that there is little chance that the ring will ever hang asymmetrically from the chain.

FIG. 3 illustrates the use of the improved beam clamp for lifting an I-beam 38, the jaws 22 engaging the flanges 40 of the beam. As pointed out in my prior patent, if the arms are engaged with the beam in an offset manner, rather than in a single plane transverse to the beam, as the chain is tightened during lifting a torque action is exerted which causes the jaws to grip the beam more tightly as the beam is lifted. FIG. 4 illustrates the use of the hook members 18 for lifting an I-beam by engagement with the undersurface of a single flange 40 of the beam. Regardless of the use of the improved beam clamp, the user benefits from the ability to replace the jaws easily and from the provision of jaws which are tailored to their purpose, and the manufacturer benefits from the reduced cost of manufacturing the ring.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. A beam clamp comprising a ring and a pair of arms, said ring consisting entirely of a plate portion and a rod portion, said rod portion having a substantially uniform circular cross-section from end to end and said plate portion having a rectangular cross-section, corresponding ends of said portions being welded together to form the ring, each arm having an opening therethrough receiving the rod portion of said ring and having a slot containing spaced jaws adapted to engage the flange of a beam.

2. A beam clamp in accordance with claim 1, wherein said plate portion has rectangular notches at the ends thereof receiving the corresponding ends of said rod portion.

3. A beam clamp in accordance with claim 2, wherein said rod portion forms a circular arc from end to end and wherein said plate portion has a central section with a curved inner side having a smaller radius of curvature than said arc.

4. A beam clamp in accordance with claim 1, wherein the ends of said plate portion are large enough to prevent entry thereof into said openings of said arms.

5. A beam clamp in accordance with claim 1, wherein said jaws are plates connected to said arms by screws.

6. A beam clamp in accordance with claim 5, wherein said screws extend through portions of said arms adjacent to said slots and are threaded terminally into said jaws.

* * * * *